US009429353B2

(12) United States Patent
Schumacher et al.

(10) Patent No.: US 9,429,353 B2
(45) Date of Patent: Aug. 30, 2016

(54) TURBO SEAL INSULATED HEAT FIN

(71) Applicant: Rytec Corporation, Jackson, WI (US)

(72) Inventors: Andrew Schumacher, West Bend, WI (US); Jeffrey Malinowski, Hartford, WI (US)

(73) Assignee: RYTEC CORPORATION, Jackson, WI (US)

( * ) Notice: Subject to any disclaimer, the term of this patent is extended or adjusted under 35 U.S.C. 154(b) by 0 days.

(21) Appl. No.: 14/538,245

(22) Filed: Nov. 11, 2014

(65) Prior Publication Data

US 2015/0135595 A1 May 21, 2015

Related U.S. Application Data

(60) Provisional application No. 61/906,631, filed on Nov. 20, 2013.

(51) Int. Cl.

| | |
|---|---|
| ***E06B 1/04*** | (2006.01) |
| ***F25D 21/04*** | (2006.01) |
| ***F25D 23/02*** | (2006.01) |
| ***F25D 13/00*** | (2006.01) |
| *E06B 1/52* | (2006.01) |

(52) U.S. Cl.

CPC ..... *F25D 21/04* (2013.01); *F25D 13/00* (2013.01); *F25D 23/021* (2013.01); *E06B 1/52* (2013.01)

(58) Field of Classification Search

CPC ..... F25D 21/04; F25D 23/021; F25D 13/00
USPC ..... 49/504; 52/204.5, 204.71, 204.597, 52/186.1, 786.11, 786.12, 786.13, 656.1, 52/656.2, 656.3, 656.4, 656.5, 656.6
See application file for complete search history.

(56) References Cited

U.S. PATENT DOCUMENTS

| | | | | |
|---|---|---|---|---|
| 3,449,925 | A * | 6/1969 | Barroero | 62/275 |
| 4,689,933 | A * | 9/1987 | Biro | 52/656.5 |
| 4,791,762 | A * | 12/1988 | Hwang | 52/171.3 |
| 4,855,567 | A | 8/1989 | Mueller | |
| 5,119,608 | A * | 6/1992 | Glover et al. | 52/171.3 |
| 5,203,175 | A * | 4/1993 | Farrey et al. | 62/82 |
| 6,152,208 | A * | 11/2000 | Kalempa et al. | 160/273.1 |
| 6,226,995 | B1 | 5/2001 | Kalempa | |
| 6,434,886 | B1 | 8/2002 | Johnson et al. | |
| 6,517,221 | B1 * | 2/2003 | Xie | 362/373 |
| 6,983,565 | B2 * | 1/2006 | Berry et al. | 49/370 |
| 7,340,907 | B2 * | 3/2008 | Vogh, III | 62/150 |
| 7,665,246 | B1 * | 2/2010 | Wagner, Jr. | 49/501 |
| 2008/0066888 | A1 * | 3/2008 | Tong et al. | 165/80.3 |
| 2013/0048251 | A1 * | 2/2013 | Xiao et al. | 165/104.26 |
| 2013/0061525 | A1 | 3/2013 | Drifka | |
| 2014/0138052 | A1 * | 5/2014 | Hsieh et al. | 165/104.14 |
| 2015/0090435 | A1 * | 4/2015 | Xia et al. | 165/185 |

FOREIGN PATENT DOCUMENTS

WO PCT/US14/65155 3/2015

* cited by examiner

*Primary Examiner* — Jerry Redman
(74) *Attorney, Agent, or Firm* — McGuire Woods LLP

(57) ABSTRACT

An apparatus, a system and a method for removing porting, and using geometry to create a heat soaked surface area in an ice area related to door assemblies. Heat conducting material such as, e.g., aluminum, is used to conduct heat efficiently to prevent icing at the transition point between an end of a door panel and its vertical guide structures in applications where freezer environments must be maintained while permitting ingress into a freezer environment, egress from a freezer environment, or both.

12 Claims, 6 Drawing Sheets

TURBO SEAL INSULATED HEAT FIN

CROSS-REFERENCE TO RELATED APPLICATIONS

This application claims priority and benefit of U.S. Provisional Application No. 61/906,631 filed Nov. 20, 2013, the disclosure of which is incorporated by reference herein in its entirety.

BACKGROUND OF THE DISCLOSURE

1. Field of the Disclosure

The disclosure relates to an apparatus, a system and a method for removing porting, and using geometry to create a heat soaked surface area in an ice area, and using a heat conducting material such as, e.g., aluminum, to conduct heat efficiently to prevent icing.

2. Related Art

Door assemblies such as used in freezer facilities typically are arranged to open and close within some type of guiding assembly, such as, e.g., a vertical pair of columns. However, the door assembly typically is not sealed with the guiding assembly, and some air flows into a space or gap between the door itself and the guiding assembly. Since the door assembly is configured in a freezer facility, the air that flows into the gap may cause build-up of frost and/or ice. This build-up of frost or ice can, over time, cause operational malfunctions and even damage to the door assembly or guiding assembly.

For example, FIG. 1 is a top view of a door assembly, according to the prior art. The door assembly 100 includes a door panel 105 that is configured to be guided by vertical panel supports 110*a*, 110*b*. The door panel 105 is configured to separate a freezer area 135 from a non-refrigerated area 140. The panel supports 110*a*, 110*b* may be mounted to a side column structure 136 that is substantially a vertical hollow column to permit mounting and to permit flowing of heated air therewith. The side column structure may be configured with a counter balance weight 130 that is used to assist in opening and closing the door by moving vertically within the side column structure 136 as needed when a door panel 105 is opened or closed. This may take some load off a motor (not shown) when moving the door panel 105. It is possible that the door panel 105 may comprise more than one actual door segment or panels stacked on one another, but, for simplicity, it is referred herein as a door panel. The door assembly 100 may be proximate or connected to a freezer wall 145, which may be a wall of a refrigerated building or room.

As shown in FIG. 1, the door panel 105 is typically positioned between the vertical supports 110*a*, 110*b*. One or more pairs of brush seals 115*a*-115*d* may be configured on the vertical supports 110*a*, 110*b* and configured to resist cold air (i.e., below freezing), but not all, from entering into a gap 120 from the freezer area 135. In an attempt to prevent ice buildup 116, a heat source 125 may be used to flow heated air into the substantially hollow side column structure 136, usually proximate a bottom area of the hollow side column structure 136 so that heated air can vent through holes 151 (FIG. 2) configured near the bottom of the hollow side column structure 136 to permit heated air flow into the interior area of the rectangular section 109*a*, 109*b* of vertical supports 110*a*, 110*b* so that the heated air can rise upwardly in the interior area of the rectangular section 109*a*, 109*b* that spans the height of the overall door panel 105. By conduction from the heated surface area of vertical supports 110*a*, 110*b*, via heat from rectangular section 109*a*, 109*b*, heat enters areas 120 in an attempt to keep this area 120 free from icing. This configuration works to a degree; however in many instances, ice formation still continues in the gap area 120 causing problems such as operational malfunctions such as frozen doors, or actual damage to the door panel 105 or door assembly 100. FIG. 2 is a side view of the side column structure 136 configured with vent holes 151 that are configured to heat the interior area of the rectangular section 109*a*, 109*b* of vertical supports 110*a*, 110*b* through vent holes 151.

There exists an unfulfilled need to provide a new solution to prevent frost and/or ice build-up in the gap of such a door assembly/guiding assembly to prevent ice build-up and associated problems.

SUMMARY OF THE DISCLOSURE

The disadvantages of the prior art are overcome by the system and method of the disclosure. An apparatus, a system and a method for removing porting, and using geometry to create a heat soaked surface area in an ice area related to door assemblies. Heat conducting material such as, e.g., aluminum, may be used to conduct heat efficiently to prevent icing at the transition point between an end of a door panel and its vertical guide structures in applications where freezer environments must be maintained while permitting ingress and/or egress from or out of a freezer environment.

In one aspect, a system for preventing icing of a door in a freezer environment includes a vertical side column structure configured with a plurality of walls forming a substantially hollow interior therewithin, the plurality of walls comprising heat conducting material, a pair of spaced-apart vertical panel supports connected to the vertical side column and configured to guide a door therebetween, one or more fins configured to extend from an exterior side of the vertical side column structure and configured to extend a distance sufficient to be proximate an end of the door, the one or more fins in thermal conductive communication with the vertical side column structure; and a heat source coupled to the vertical side column structure to supply heated air into the substantially hollow interior, wherein heat radiated by the one or more fins is sufficient to prevent icing in an area proximate the one or more fins and at least one wall of the vertical side column due to the freezer environment. The system may further comprise the door configured between the pair of spaced-apart vertical panel supports, the door configured to move in a vertical direction. The one or more fins may be a pair of fins configured to form a gap therebetween and may be positioned to be proximate an end of the door when installed and the pair of fins are configured to radiate heat proximate the end of the door to prevent icing proximate the end of the door. The system may be configured so that the gap is not artificially heated by convection through ports in the vertical side column structure. The system may further comprise at least one air flow inhibitor connected to the pair of spaced-apart vertical panel supports and configured to be in contact with the door to inhibit air flow into the gap. The one or more fins may be a pair of fins and may comprise an integral part of the vertical side column structure. In one aspect, a method for preventing icing of a door in a freezer environment may include the steps of providing a hollow vertical side column configured to be heated therewithin with a heat source, the hollow vertical side column configured to support a door panel and providing a heat source to provide heat by conduction from the hollow vertical side column to a pair of fins extending from an exterior side of the hollow vertical side column, the pair of fins positioned to be proximate an end of the door panel for preventing icing or frosting of a gap area between the end of the door and the pair of fins. The method may further comprise connecting two spaced apart vertical panel supports to the hollow vertical side column for guiding movement of the door panel. The method may further comprise configuring at least one air flow inhibitors on the two spaced apart vertical panel supports configured to be in contact with the door. The at least one air flow inhibitors may be positioned proximate the end of the door panel. A pair of fins extending into the hollow interior and positioned opposite the pair of fins may be configured on an exterior side of the vertical side column structure, both pairs of fins may be configured on a same wall of the vertical side column structure. The vertical side column structure and the pair of fins may be monolithic.

Additional features, advantages, and embodiments of the disclosure may be set forth or apparent from consideration of the following attached detailed description and drawings. Moreover, it is to be understood that both the foregoing summary of the disclosure and the following attached detailed description are exemplary and intended to provide further explanation without limiting the scope of the invention as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the invention in more detail than may be necessary for a fundamental understanding of the disclosure and the various ways in which it may be practiced.

DETAILED DESCRIPTION OF THE DISCLOSURE

Figure 1:
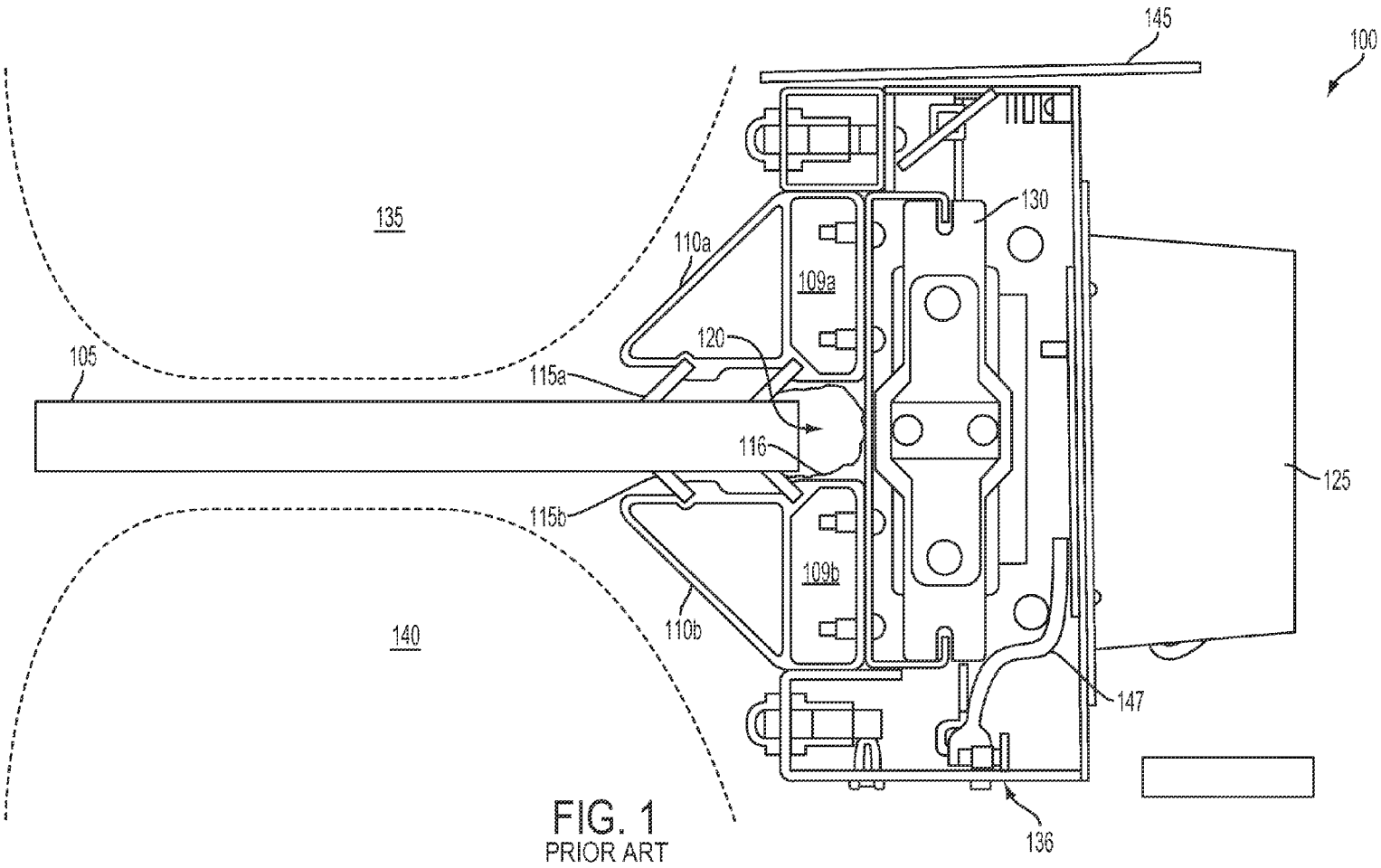
FIG. 1 PRIOR ART
FIG. 1 is a diagram of a door assembly, configured according to principles of the disclosure.
Figure 2:
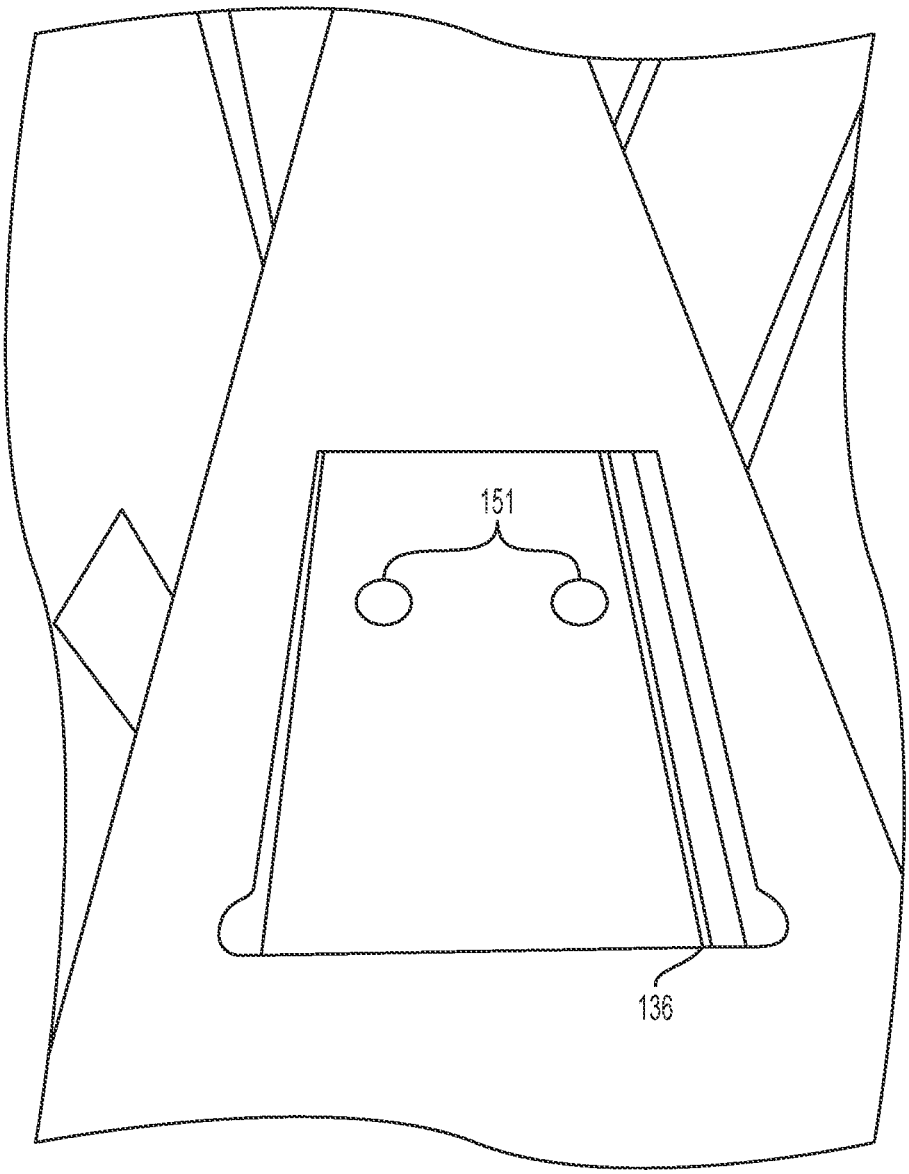
FIG. 2 PRIOR ART
FIG. 2 is a partial front perspective view of the door assembly of FIG. 1.

The embodiments of the disclosure and the various features and advantageous details thereof are explained more fully with reference to the non-limiting embodiments and examples that are described and/or illustrated in the accompanying drawings, and detailed in the following attached description. It should be noted that the features illustrated in the drawings are not necessarily drawn to scale, and features of one embodiment may be employed with other embodiments as anyone skilled in the art would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise. The term "about" means within 10%, unless context indicates otherwise.

Although process steps, method steps, or the like, may be described in a sequential order, such processes, and methods may be configured to work in alternate orders. In other words, any sequence or order of steps that may be described does not necessarily indicate a requirement that the steps be performed in that order. The steps of the processes or methods described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

Figure 3:
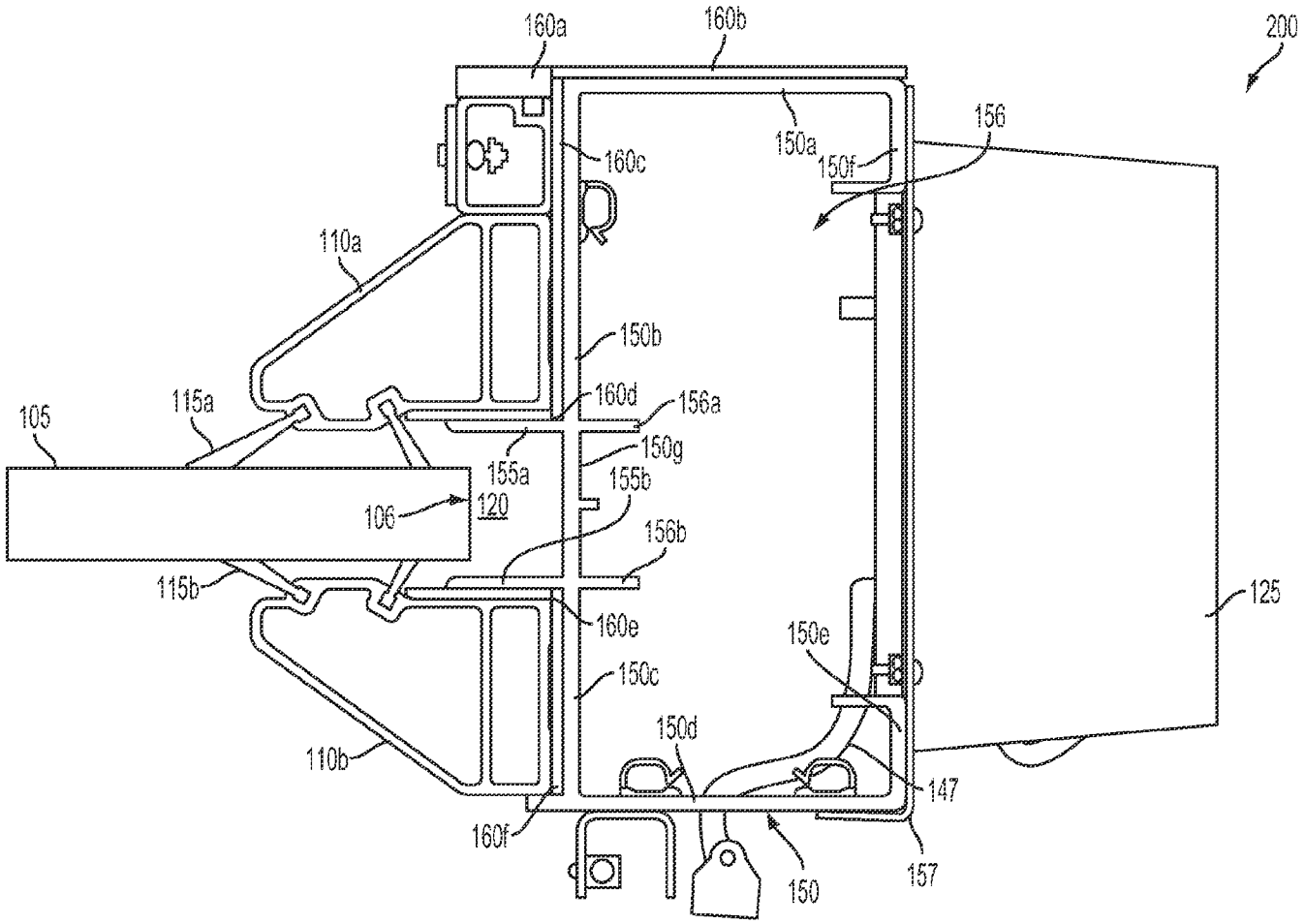
FIG. 3 is a diagram of a top view of a door assembly, configured according to principles of the disclosure.
Figure 4:
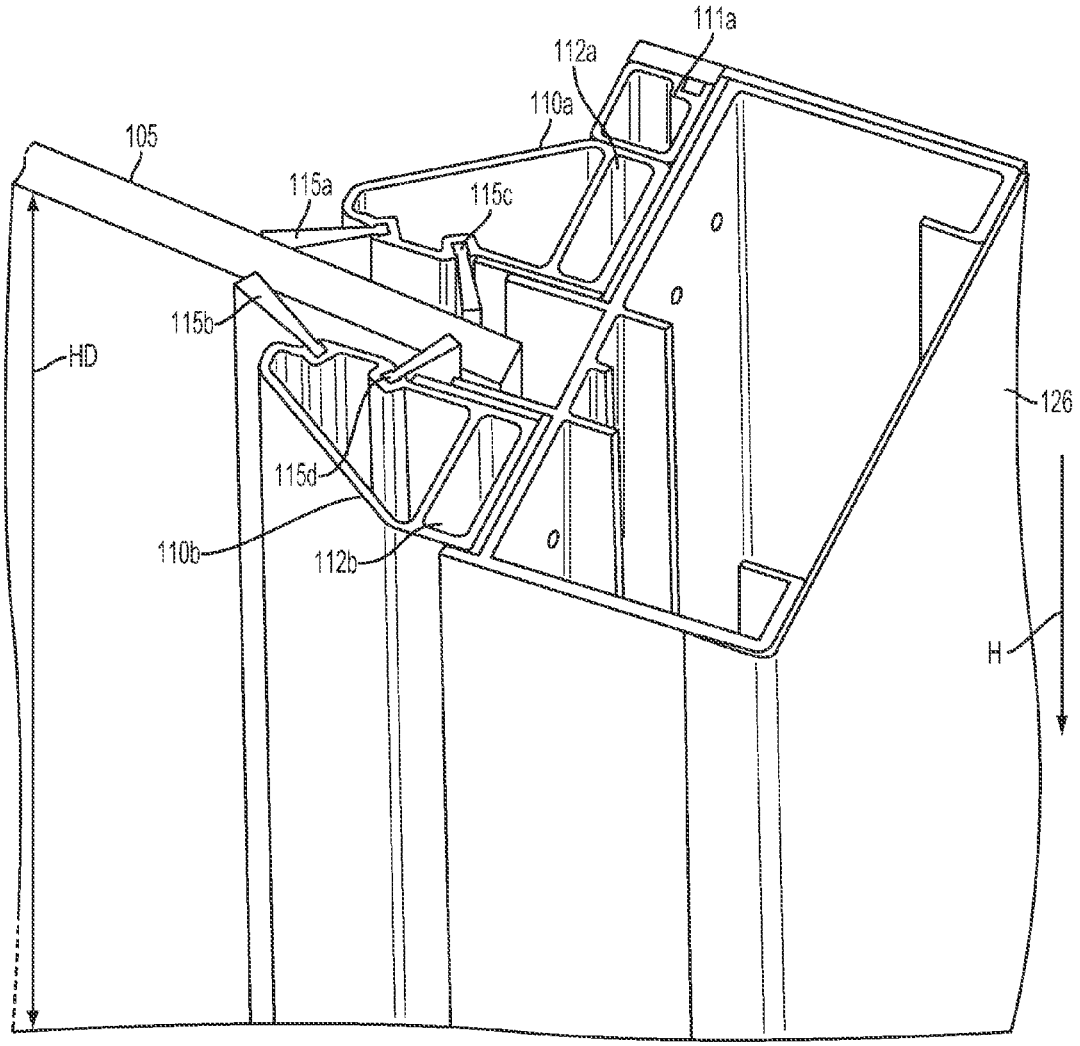
FIG. 4 is a top partial perspective view of FIG. 3.

FIG. 3 is a diagram of a top view of a door assembly, configured according to principles of the invention. FIG. 4 is a top partial perspective view of FIG. 3. The door assembly 200 may comprise door panel 105 that is configured to be guided at an end 106 by vertical panel supports 110*a*, 110*b*. Door panel 105 may be about the same height as vertical panel supports 110*a*, 110*b*. The vertical panel supports may comprise, e.g., fiberglass, plastic, a composite material, or the like. The door panel 105 may be a single panel. In some applications, the door panel 105 may comprise a plurality of stacked individual sub-panels. The door panel 105 is configured to be moved along and within the vertical panel supports 110*a*, 110*b*, as needed to permit opening and closing of the door panel 150 as needed. The door panel 105 may be configured to separate a freezer area 135 from a non-refrigerated area 140, as describe in relation to FIG. 1. The non-refrigerated area 140 may be ambient surroundings, which may or may not experience freezing temperatures due to ambient conditions (such as weather) at some points in time. Vertical panel supports 110*a*, 110*b* may include one or more enclosed chambers 112*a*, 112*b*. Moreover, secondary vertical spacers 111*a* may be used to secure vertical panel supports 110*a*, 110*b* along an outer side of the vertical side column structure 150.

The opening of the door panel 105 may be in a vertical direction wherein the door panel 105 may be raised to permit egress from either the freezer area 135 to the non-non-refrigerated area 140, or conversely. Likewise, the door panel 105 may be lowered in a vertical direction to establish a closed condition with a barrier in place whereby freezer conditions are maintained in the freezer area 135.

The panel supports 110*a*, 110*b* may be mounted to vertical side column structure 150. The panel supports 110*a*, 110*b* may be configured with at least one air flow inhibitor, such as brush seals 115*a*, 115*b*, that may be connected to the pair of spaced-apart vertical panel supports 110*a*, 110*b* and may be configured to be in contact with the door to inhibit air flow into a gap 120 proximate an end of the door panel 105. The at least one air flow inhibitor may comprise one or more pairs of brush seals 115*a*, 115*b* and 115*c*. 115*d* (or similar air flow inhibiting structures, e.g., foam, rubber type material or the like) that may be positioned to contact the door panel 105 along the height HD for inhibiting air flow into the gap 120 between door panel 105 and at least one of the pair of spaced-apart vertical panel supports 110*a*, 110*b*.

The vertical side column structure 150 may be configured to permit mounting to more permanent structures such as a permanent wall, a rigid structure, or the like. Vertical side column structure 150 may comprise wall segments 150*a*-150*g* configured to form a vertical substantially hollow area 156 to permit flowing of heated air therewithin. Vertical side column structure 150 may be about the same height as vertical panel supports 110*a*, 110*b*. The vertical side column structure 150 may comprise an efficient heat conducting material which may be a metal, such as e.g., aluminum, steel, copper, an alloy, or the like. A heat source 125 may be configured to supply heated air into the substantial hollow interior. The heat source 125 may be mounted on a side of the vertical side column structure 150 to provide heated air into the substantially vertical hollow area 156. A cover 157 may be configured to enclose, as needed, the side of the vertical side column structure 150 where the heat source is connected, to assure that heat is effectively contained within the substantial hollow interior 156 of the vertical side column structure 150, and to substantially enclose a perimeter of the vertical side column structure 150. A power cable 147 may connect the heat source 125 to a power source. The power cable 147 may be connected to the heat source in different ways, as one of ordinary skill in the art would recognize.

In some applications, the vertical side column structure 150 may be configured with a counter balance weight such as weight 130 (FIG. 1) that may be used to assist in opening and closing the door by moving vertically within the side column structure 150 as needed when a door panel 105 is opened or closed. The door assembly 200 may be proximate or connected to a freezer wall (such as, e.g., wall 145 of FIG. 1), which may be a wall of a refrigerated building, compartment or room.

The vertical side column structure 150 may be configured with a first set of fins 156*a*, 156*b* (or one or more fins) configured as part of and/or projecting inwardly from an interior wall 150*b*, 150*c* of the side column structure 150 into the substantially vertical hollow area 156. The first set of fins 156*a*, 156*b* may be formed as part of the side column structure 150, and may extend along the entire height of the side column structure 150, along a substantial height thereof, or along a partial height thereof. Since the air within the substantially vertical hollow area 156 is heated by heat source 125, the first set of fins 156*a*, 156*b* is bathed in the heated air, and conducts heat as a consequence. A second set of fins 155*a*, 155*b* (or, alternatively, one or more fins 155*a*, 155*b*) may be configured to project from the exterior of side column structure 150. The second set of fins 155*a*, 155*b* may form or border a gap 120 therebetween. The second set of fins 155*a*, 155*b* may extend along the entire height of the side column structure 150, along a substantial height thereof, or along a partial height thereof. The second set of fins 155*a*, 155*b* may be configured opposite the first set of fins 156*a*, 156*b* of the side column structure 150. Preferably, the first set of fins 156*a*, 156*b* and second set of fins 155*a*, 155*b* may be formed as an integral part of the side column structure 150, which may be formed by extrusion as a common component. Alternatively, the first set of fins 156*a*, 156*b* and second set of fins 155*a*, 155*b* may be separate components from the side column structure 150, but connected to the side column structure 150. The second set of fins 155*a*, 155*b* is configured to be in thermal conductive communication with the vertical side column structure 150. The first set of fins 156*a*, 156*b* is configured to be in thermal conductive communication with the vertical side column structure 150. As the vertical side column structure 150, which may include the first set of fins 156*a*, 156*b* and walls 150*a*-150*g*, is heated by heat source 125, the second set of fins 155*a*, 155*b* are heated by thermal conductive communication. The vertical side column structure 150, the first set of fins 156*a*, 156*b* and walls 150*a*-150*g*, and the second set of fins 155*a*, 155*b* may be formed of the same heat conducting material such as a metal like, e.g., aluminum. The vertical side column structure 150, the first set of fins 156*a*, 156*b*, walls 150*a*-150*g*, and the second set of fins 155*a*, 155*b* may be configured as a monolithic structure of the same heat conducting material; and may be formed by a common process such as extrusion.

The second set of fins 155*a*, 155*b* (or one or more fins 155*a*, 155*b*) may be configured to extend in a parallel manner in relation to one another from the side column structure 150 at a distance sufficient to be proximate the end 106 of the door panel 105. The distance of extent should be sufficient to be proximate the end 106 of the door panel 105 when installed between the panel supports 110*a*, 110*b*. Preferably, the second set of fins 155*a*, 155*b* may be configured to extend in a parallel manner in relation to one another from the side column structure 150 sufficient to overlap with door panel 105, but an overlap is not necessarily a requirement. The second set of fins 155*a*, 155*b* along with a portion of the wall 150*g* may be configured to surround the gap 120 on three sides. The second set of fins 155*a*, 155*b* and wall 150*g* are heated via conduction by heated air within the substantially vertical hollow area 156, which also has been heating conducting walls 150*a*-150*f* that also provide heat by conduction to the second set of fins 155*a*, 155*b*. Additionally, the first set of fins 156*a*, 156*b* which extend into the substantially vertical hollow area 156 to be heated also enhances the efficiency of heat conduction to the second set of fins 155*a*, 155*b*.

The second set of fins 155*a*, 155*b*, when heated by conduction, efficiently provides heat into the gap 120 in sufficient amounts from a plurality of different geometric directions such as three directions (i.e., from each fin 155*a*, 155*b* and wall 150*g*) to prevent frosting or build-up of ice proximate end 106. The geometry of the heat sources proximate gap 120 (i.e., fin 155*a*, 155*b* and wall 150*g*) creates a type of oven effect that projects or radiates heat into the gap 120 along a vertical extent H (FIG. 4) of the side column structure 150. The vertical extent H may vary in different applications. Vertical extent H may be substantially the same as height HD (FIG. 4) as door panel 105. Height HD may vary depending on application. The heat may be conducted and radiated into the gap 120 along the entire height of the side column structure 150, along a substantial height thereof, or along a partial height thereof, and may be substantially along the entire height of the door panel 105. The heat prevents icing or frosting in the gap 120 which prevents damage to the door assembly 200 and prevents or minimizes operational problems due to icing or frost build-up, such as, e.g., frozen door panel 105 with vertical panel supports 110*a*, 110*b*.

To assist in thermal conductivity efficiency, insulation may be configured at strategic positions. For example, insulation 160*a*, 160*b*, 160*c*, 160*d*, 160*e*, 160*f* may be positioned proximate or along a wall of vertical panel supports 110*a*, 110*b*, side column structure 150 or one or more of second set of fins 155*a*, 155*b* with any adjacent component such as vertical panel supports 110*a*, 110*b*, side column structure 150 or one or more of second set of fins 155*a*, 155*b*. The insulation may comprise foam insulation, but other types of insulation may be used. The insulation 160*a*, 160*b*, 160*c*, 160*d*, 160*e*, 160*f* assists in promoting or maintaining efficient heat conduction in side column structure 150 to and within the second set of fins 155*a*, 155*b* and into gap 120 by preventing or reducing undue losses of heat.

The configuration described above in relation to FIGS. 3 and 4 eliminates the need for porting of heat by convection into the gap 120, as used in traditional type configurations. That is, the gap 120 is not artificially heated by convection through ports in the vertical side column structure 150. Rather the gap 120 is kept free of icing or frost by conduction of heat into the gap 120 by geometric orientation of heat transferring fins 155*a*, 155*b* in conjunction with the wall 150*g* of the vertical side column 10. As shown in relation to FIGS. 3 and 4, heat conducting material such as, e.g., aluminum, steel or the like, is used to conduct heat efficiently using geometry of the heat conducting material to prevent icing at the transition point between an end of a door panel and its vertical guide structures in applications where freezer environments must be maintained while permitting ingress and/or egress from or out of a freezer environment. The system of FIGS. 3 and 4 may be substantially more effective, reliable and/or efficient in preventing icing in the gap 120, as compared with traditional systems.

Figure 5:
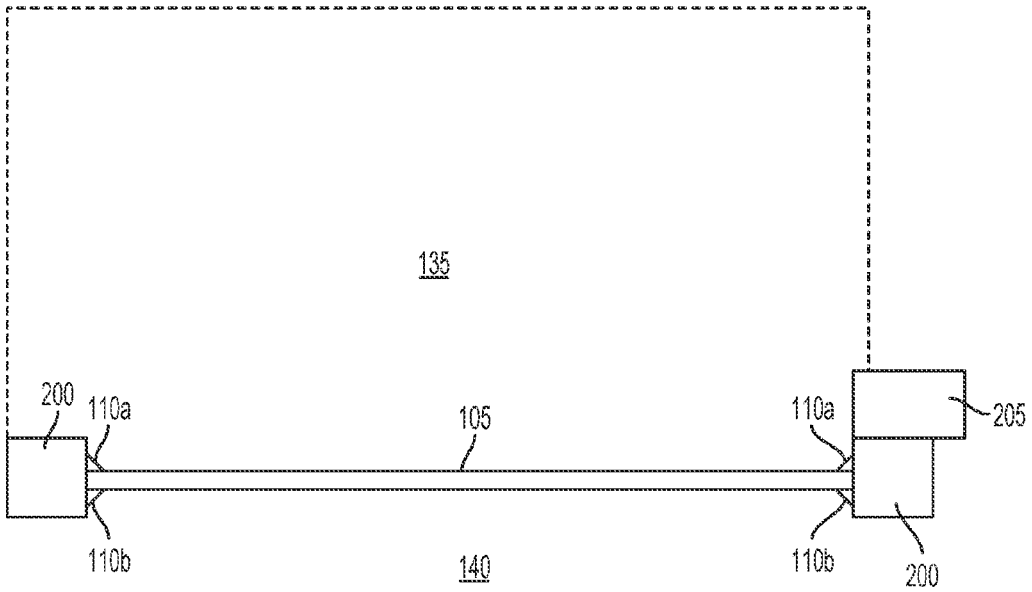
FIG. 5 is an example schematic of an environment employing the concepts of FIGS. 3 and 4, configured according to principles of the disclosure.

FIG. 5 is an example schematic of an environment employing the concepts of FIGS. 3 and 4, configured according to principles of the disclosure. The environment 250 may comprise door assemblies 200 including door panel 105 which comprises a door installed between the panel supports 110*a*, 110*b*. A refrigeration unit 205 may provide refrigerating capacity to cause freezing conditions in the freezer area 135 (or refrigerated area). The freezer area 135 may be of arbitrary size such as a room, a building, or the like. A non-refrigerated area 140 is shown opposite the freezer area 135 with door panel 105 configured therebetween.

Figure 6:
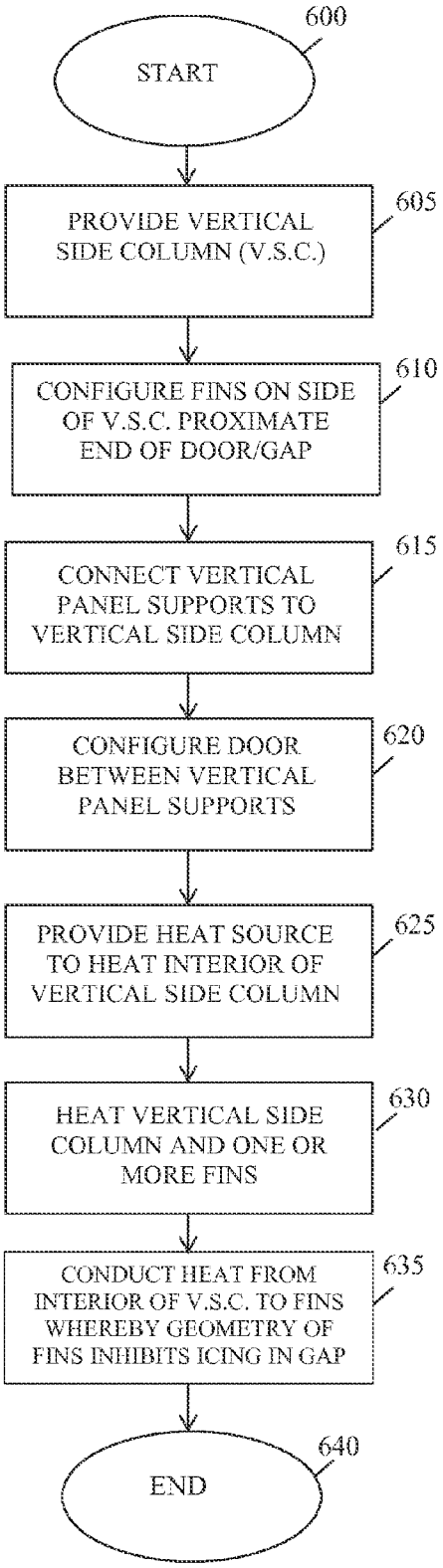
FIG. 6 is a flow diagram showing an exemplary process, the steps performed according to principles of the disclosure

FIG. 6 is a flow diagram showing an exemplary process, the steps performed according to principles of the disclosure, beginning at step 600. The order of the steps may vary. At step 605, one or more vertical side column structure may be provided. This may comprise, e.g., vertical side column structure 150, such as described above. At step 610, one or more fins, or at least one pair of fins, such as, e.g., fins 155*a*, 155*b* may be formed on the exterior side of the one or more vertical side column structures. The fins may be configured to be proximate an end of a door when installed and to surround, at least in part, a gap between the end of the door and the vertical side column structure, e.g., gap 120. At step 615, one or more vertical panel supports, such as e.g., supports 110*a*, 110*b* may be connected to the vertical side column structure. The one or more vertical panel supports are configured to guide movement of the door panel. The vertical panel supports may be configured with one or more air flow inhibitors such as e.g., brushes 115*a*-115*d*, which may be configured in one or more pairs contacting a door, e.g., door panel 105, when in a closed position to inhibit air flow into the gap. At step 620, a door such as, e.g., door panel 105, may be configured between the vertical panel supports, so that the vertical panel supports guide the door when opening and closing the door. A gap such as gap 120 typically occurs between and end of the door and the at least one pair of fins, such as, e.g., fins 155*a*, 155*b* and a wall of the vertical side column structure. In one aspect, an extent of the gap may also be contained or defined by the one or more air flow inhibitors. At step 625, a heat source such as, e.g., heat source 125 may be provided to heat the interior of the vertical side column structure. At step 630, the vertical side column structure interior and fins such as, e.g., fins 156*a*, 156*b*, may be heated. At step 635, heat may be conducted in sufficient amount to convey amount of heat to fins proximate the gap, e.g., fins 155*a*, 155*b* to effectively inhibit icing or frost build-up, thereby preventing damage or operational problems due to icing or frost build-up to the door or door assembly. This heating may include heating a plurality of walls of the vertical side column structure; and may include heating other fins on the interior such as, e.g., fins 156*a*, 156*b*, which may act as an enhanced heat conducting mechanism to the fins opposite and proximate the gap, e.g., fins 155*a*, 155*b*. The heating and conduction into the gap may continue as needed to assure ice prevention or frosting in the gap. At step 640, the process may end.

While the disclosure has been described in terms of exemplary embodiments, those skilled in the art will recognize that the disclosure can be practiced with modifications in the spirit and scope of the appended claims and drawings. The examples provided herein are merely illustrative and are not meant to be an exhaustive list of all possible designs, embodiments, applications or modifications of the disclosure.

What is claimed:

1. A system for preventing icing of a door in a freezer environment, comprising:

a vertical side column structure comprising a plurality of walls forming a substantially hollow interior therewithin, the plurality of walls comprising heat conducting material;

a pair of spaced-apart vertical panel supports connected to the vertical side column and guiding a door therebetween;

one or more fins that extend from an exterior side of the vertical side column structure and extend a distance sufficient to be proximate an end of the door, the one or more fins being in thermal conductive communication with the vertical side column structure; and a heat source coupled to the vertical side column structure and supplying heated air into the substantially hollow interior, wherein the one or more fins radiates heat that is sufficient to prevent icing in an area proximate the one or more fins and at least one wall of the vertical side column due to the freezer environment, wherein the one or more fins comprise a pair of fins that form a gap therebetween and positioned to be proximate an end of the door when installed, and the pair of fins radiate heat proximate the end of the door to prevent icing proximate the end of the door, and wherein the pair of fins cover portions of the pair of spaced-apart vertical panel supports surrounding the gap, respectively.

2. The system of claim 1, further comprising the door configured between the pair of spaced-apart vertical panel supports, the door configured to move in a vertical direction.

3. The system of claim 1, wherein the gap is not artificially heated by convection through ports in the vertical side column structure.

4. The system of claim 1, further comprising at least one air flow inhibitor connected to the pair of spaced-apart vertical panel supports and configured to be in contact with the door to inhibit air flow into the gap.

5. The system of claim 1, wherein the pair of fins are an integral part of the vertical side column structure.

6. The system of claim 1, further comprising one or more fins extending from an interior side of the vertical side column structure into the substantially hollow interior to assist in conducting heat from the heated air to the one or more fins extending from then exterior side of the vertical side column structure.

7. The system of claim 6, wherein the one or more fins extending from an interior side of the vertical side column structure are an integral part of the vertical side column structure.

8. The system of claim 1, wherein the heat conducting material comprises a metal.

9. The system of claim 8, wherein the metal comprises aluminum.

10. The system of claim 1, wherein the vertical side column structure and the one or more fins are monolithic.

11. The system of claim 10, wherein the vertical side column structure and the one or more fins are metal.

12. The system of claim 1, further comprising insulation sandwiched between the pair of spaced-apart vertical panel supports and the pair of fins.

* * * * *